United States Patent [19]

Stoll

[11] Patent Number: 4,643,408

[45] Date of Patent: Feb. 17, 1987

[54] CLAMPING ELEMENT WITH A SHORT STROKE

[76] Inventor: Kurt Stoll, Lenzhalde 72, 7300 Esslingen, Fed. Rep. of Germany

[21] Appl. No.: 695,444

[22] Filed: Jan. 28, 1985

[30] Foreign Application Priority Data

Jan. 28, 1984 [DE] Fed. Rep. of Germany ..... 3402913

[51] Int. Cl.[4] ..... B25B 11/00

[52] U.S. Cl. ..... 269/22

[58] Field of Search ..... 269/22, 266; 254/93 HP; 92/90, 93, 94, 96, 103 F, 104

[56] References Cited

U.S. PATENT DOCUMENTS

| | | | |
|---|---|---|---|
| 2,396,413 | 3/1946 | Egger | 264/22 |
| 2,560,902 | 7/1951 | Smith | 269/22 |
| 2,714,011 | 7/1955 | Albee | 269/22 |
| 2,778,865 | 1/1957 | Kongsgaarden | 269/22 |
| 3,237,252 | 3/1966 | Ratcliffe | 269/22 |
| 3,253,854 | 5/1960 | Hollander | 269/22 |
| 3,440,759 | 1/1970 | Troutner | 269/22 |
| 3,565,398 | 2/1971 | Floria et al. | 254/93 HP |
| 3,595,555 | 7/1971 | Cameron . | |
| 3,608,809 | 9/1971 | Cushman | 269/22 |
| 3,638,973 | 2/1972 | Poletti | 269/22 |
| 3,856,291 | 12/1974 | Nilsen | 269/22 |
| 4,470,585 | 9/1984 | Bavelloni | 269/22 |

FOREIGN PATENT DOCUMENTS

| | | |
|---|---|---|
| 467952 | 6/1937 | United Kingdom . |
| 565401 | 11/1944 | United Kingdom . |
| 1007213 | 10/1965 | United Kingdom . |
| 1344656 | 1/1974 | United Kingdom . |
| 1468375 | 3/1977 | United Kingdom . |
| 2097300 | 11/1982 | United Kingdom . |

*Primary Examiner*—Robert C. Watson
*Attorney, Agent, or Firm*—McGlew and Tuttle

[57] ABSTRACT

A short-stroke clamping element for exerting a holding force on a workpiece has the form of a bar with an internal pressure chamber, and is adapted to produce the clamping force in a direction normal to its length. The pressure chamber, which is adapted to have fluid under pressure supplied to it, is confined by peripheral and terminal walls. The chamber runs from one end of the bar to the other, one of such peripheral walls forming a clamping jaw constituted by an outwardly moving wall of said chamber and able to bulge outwards under the action of such pressure fluid.

6 Claims, 7 Drawing Figures

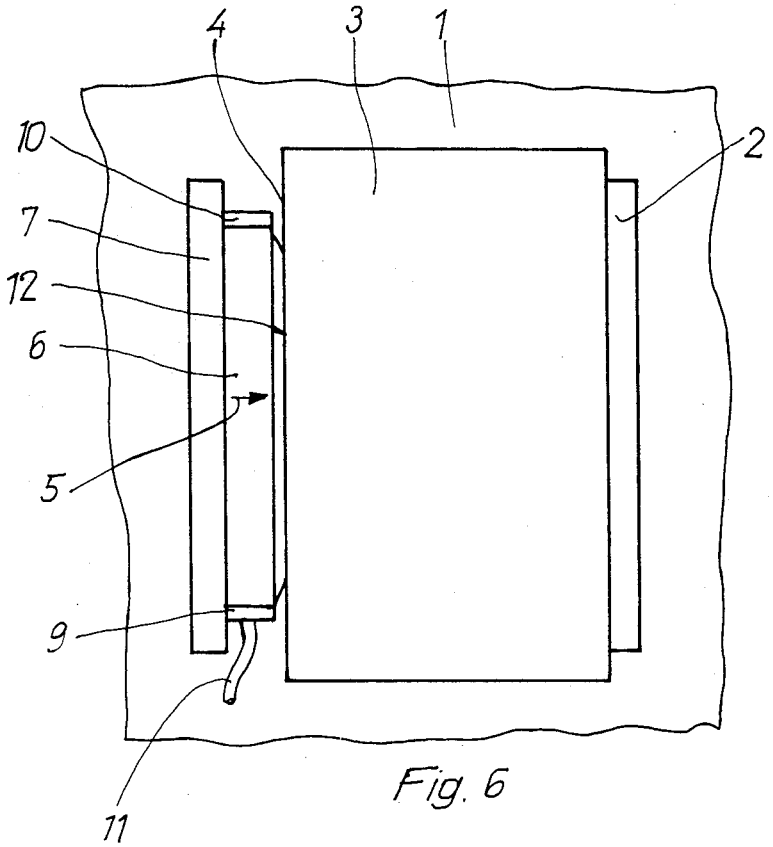
Fig. 6
Fig. 7
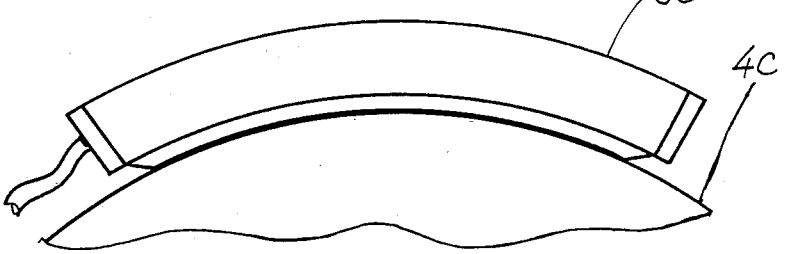

CLAMPING ELEMENT WITH A SHORT STROKE

BACKGROUND OF THE INVENTION

The present invention relates to clamping elements or fixtures with a short clamping stroke, designed to exert a clamping or other holding force on a workpiece and having an internal cavity to be supplied with driving fluid, more particularly compressed air.

If a workpiece is to be machined it has to be placed on the work table of the machine tool or other manufacturing device and clamped in place to keep it from changing its position in the course of the machining operation that is to take place, as for example the production of a hole. It is more particularly in mass-production of workpieces that clamping fixtures, that are permanently mounted on the machine, are used in the form of clamping cylinders whose plungers are moved outwards when fed with driving fluid to press the work against a counter abutment. In this respect the number of clamping cylinders depends on the dimensions of the respective workpiece. If the workpiece has a large surface area, it will be necessary to use a number of clamping cylinders spaced out from each other in a row along the workpiece.

However such an arrangement with a series of clamping cylinders uses a large amount of material and is comparatively expensive. Furthermore on tooling up the machine the clamping cylinders have to be individually set in place so that the tooling process is slowed down. A further point is that the clamping cylinders engage the work at a limited number of separate points so that there is a high specific pressure exerted at such positions if the clamping force is to be high enough. This may result in damage to the work, as for example in the case of wooden structures that are then prove to have been dented by the impression of the piston plungers.

SHORT OUTLINE OF THE PRESENT INVENTION

Consequently one purpose of the present invention is to design a shortstroke clamping element, of the sort noted at the outset, with the help of which a workpiece, having a relatively long edge to be clamped against, may be engaged more cheaply and more simply.

A further object of the instant invention is to widen the application of such a clamp so that it may be used for workpieces that are not able to resist high clamping forces.

In order to effect these and other objects of the invention that will appear in the course of the ensuing account, the clamping element is in the form of a bar adapted to produce a clamping force in a direction perpendicular to its length direction, said bar comprising an inner pressure chamber that is confined by peripheral and terminal walls, one of such peripheral walls on a long side of the bar forming a clamping jaw which may be moved in an outward direction when fluid is supplied under pressure into the chamber.

This clamping element makes it possible to dispense with a row of clamping cylinders and replace them by a single clamping element in the form of one such clamping bar placed along the one edge of the workpiece that is to be clamped in position on the work table of a machine. Such a clamping bar is very simple in its structure and, unlike known arrangements, needs only one connection for the supply and discharge of fluid under pressure. If the pressure chamber is charged with driving fluid under the control of a control valve, the said jaw of the pressure chamber will be pushed outwards or will bulge so that a sort of pressure cushion is formed, along the full length of the bar, and makes contact with the workpiece. This short stroke clamping element is capable of exerting high clamping forces even despite its small dimensions. In this respect the engagement of the work right the way along the bar keeps the surface pressure to values lower than hitherto encountered and moreover the bulging wall or jaw will make a snug fit against the surface of the edge of the workpiece even if it is uneven. A further useful effect is that such a clamping element does not need any upkeep or maintenance.

The clamping bar in keeping with the invention may be used not only in conjunction with the clamping of workpieces on the work table of a machine tool but furthermore for example in connection with appliances for handling materials, in which case it may be used as part of a gripping means.

An account will now be given of working examples of the invention as based on the accompanying diagrammatic drawings.

LIST OF THE VARIOUS VIEWS OF THE FIGURES

Figure 3:
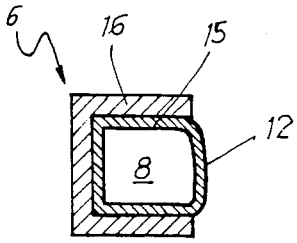
FIG. 3 is a view of the same clamping bar as seen in a cross section as taken on the line III—III of FIG. 2.
Figure 4:
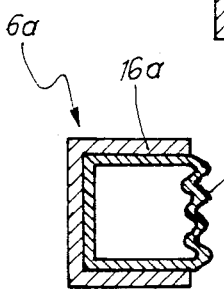
Figure 5:
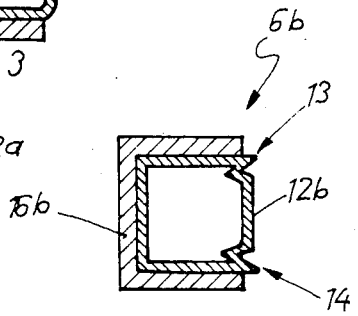

FIGS. 4 and 5 respectively show a modified form of clamping bar in cross sections similar to that of FIG. 3.

FIG. 6 is a plan view of a workpiece being clamped on the table of a machine tool by a clamping element in keeping with the present invention.

FIG. 7 is a view like that of FIG. 6 of a similar clamping element that has a curved form.

DETAILED ACCOUNT OF WORKING EXAMPLES OF THE INVENTION

On the table (see FIG. 6) of a machine tool a counter-abutment or backup 2 in the form of a rail is fixedly mounted so that a workpiece 3, that has comparatively large dimensions, more particularly in the direction of the abutment, may be clamped thereagainst. For this purpose a short-stroke clamping element is fixed to the table at the opposite edge of the workpiece 4. This clamping element is of elongated or long form and is adapted to produce a clamping effect in a direction normal to its length. This clamping element takes the form of a clamping bar 6 which may be directly mounted on the table 1 itself or it may be mounted on an attachment rail 7, that for its part is rigidly joined to the table 1 in some conventional way.

Within the clamping bar 6 there is a pressure chamber 8 to be seen in cross section in FIG. 3 and running from end to end of the clamping bar 6. The chamber 8 is confined by peripheral or side walls and terminal or end walls so that the chamber is hermetically shut off from the outside. At the ends of the clamping bar 6 there are end walls 9 and 10, of which at least one has a connection for a pressure connection or duct 11. Both the end walls or plates may have such connections. By way of the duct 11 the chamber may be charged with fluid under pressure and the fluid may be let off therefrom. The control of the supply and discharge of such fluid is by way of a valve that is not shown here, because those in the art will be familiar with the use of such a valve. The back wall of bar 6 facing away from the workpiece, is rigid and is connected to the side walls and end walls to close the back, side and end of chamber 8. The front of the bar 6, that is turned towards the workpiece 3 in use and forms a gripping or clamping jaw, is designed in the form of a wall 12, that moves outwards in the clamping direction 5 when the chamber 8 is charged with fluid under pressure. The result may be looked upon as a sort of bar-like pressure cushion, swelling along the moving wall 12 when the said pressure chamber is put under pressure by the supply of compressed air thereto. For the clamping of a workpiece 3 a stroke of some millimeters, as for example one to two millimeters is sufficient. The moving or "breathing" wall 12 will come into engagement for more or less the entire length of the clamping bar to grip the edge of the workpiece 4 pressing same against the backup 2.

It will now be possible to move a tool such as a drill or a router or the like, into position over the workpiece 3 (viz. over the plane of the paper) for machining the work. If the air is let off from the pressure chamber 8, the moving wall 12 will be deflated and let go of the work.

The moving wall 12 is made of a flexible and more specially elastic material, a useful one in this respect being a suitable synthetic resin which preferably has rubber-like properties.

In the case of FIG. 3 it is a question of a moving wall 12, that when acted upon by the fluid under pressure bulges outwards evenly and on making contact with the edge of the workpiece is forced to form a plane surface of contact, except where it is next to the neighboring sides of the bar.

On the other hand in the case of FIG. 4, the moving wall 1*a* of the clamping bar 6*a* will be seen from its cross section to be somewhat corrugated or folded. It will at once be clear that because of this bellows-like form the moving wall 12*a* may bulge outwards and expand to a greater extend than was possible with the design of FIG. 3.

It is furthermore possible, see FIG. 5, for the moving wall 12*b* of this gripping bar 6*b* to be made generally flat, it then joining by way of forms of joints with the adjacent long sides of the bar, as for example as illustrated by the use of structures 13 and 14 which may be seen from the cross section to be corrugated or fold-like, at which positions it is furthermore possible to have parts with such a small thickness that, as is the case of the parts 13 and 14 pictured, deformation will be limited to such positions, whereas the moving wall 12*b* as such moves parallel to itself. If desired, it is in this case furthermore possible for the moving wall 12*b* to be reinforced as well, for example by being made thicker or by having a reinforcing layer therein.

It will be clear that the moving wall or its joint connections will have such a wall thickness and will be made of such a material that in the case of the pressures coming into question (preferably of the order of 6 bar) one may be certain of a positive and reliable gripping effect on the workpiece, that is to say, one may be sure of having the necessary size of stroke. If the material is elastic, the moving wall will automatically return when the air is discharged from the pressure chamber. However in the case of material which is only flexible, the limpness of the wall when depressurized makes it readily possible for the workpiece 3 to be put in place and taken out again.

In all the working examples to be seen the moving wall, as for example the wall 12, is formed by an hollow integral resin section 15, whose sides, with the exception of the long side forming the moving wall 12, are reinforced or supported so that they will not be deformed on pressure fluid being supplied into the pressure chamber. In all the working examples it is a question of clamping bars that are generally rectangular in cross section, the moving wall 12 being one of the sides of such rectangle. The stiffness of the other long sides is ensured in the illustrated working examples of the invention since the single piece hollow resin section or tube 15, with the exception of the side forming the moving wall 12, is encompassed in a rigid shell section 16, that is made of rigid synthetic resin or metal. As looked at in cross section this rigid shell section 16 is made in the form of a channel matching the form of the hollow resin section 15, the hollow resin section 15 being so inserted and fixed in place, for example by bonding, so that the moving wall 12 projects somewhat past the free ends of the sides of the channel section.

The same is furthermore true of the working examples to be seen in FIGS. 4 and 5, so that in this case as well it is a question of a corresponding rigid shell section 16*a* or 16*b*.

Owing to the use of pieces of section running from end to end of the clamping bar, production is simplified substantially, since the lengths of material may be cut off from stocked section material.

In the case of a further possible form of the invention that is not shown, and in which there is again a plastic section encompassing the pressure chamber within it, the long side forming the moving wall is made of soft resin and the other sides are made of hard resin, the two materials being integrally molded. In this case it is no longer necessary to employ a separate support body like the rigid shell section 16. Therefore this form of the invention makes particularly good use of the materials available.

Figure 1:
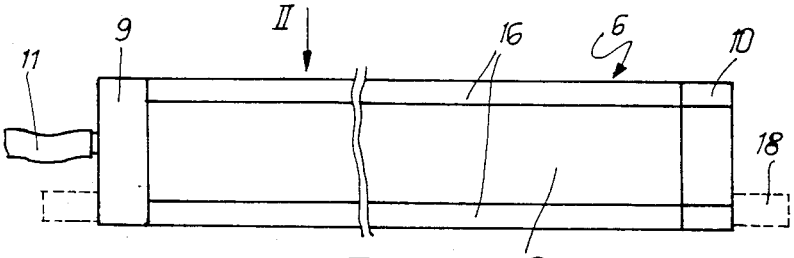
FIG. 1 is a front view of a clamping bar in keeping with the invention looking from the work that is to be held.

As marked in broken lines in FIG. 1, there are attachment projections 17 and 18 on the end covers 9 and 10 so that the bar clamp may be mounted on the table 1 therewith.

Dependent on the particular application, the bar clamp does not have to be straight in all cases. It may be adapted to match irregular workpieces so that it may for example be curved as will be seen diagrammatically in FIG. 7. In this case the bar clamp 6*c* is arcuate, although in other respects it is designed as already indicated. It clamps onto a cylindrical edge of a workpiece 4*c*.

Figure 2:
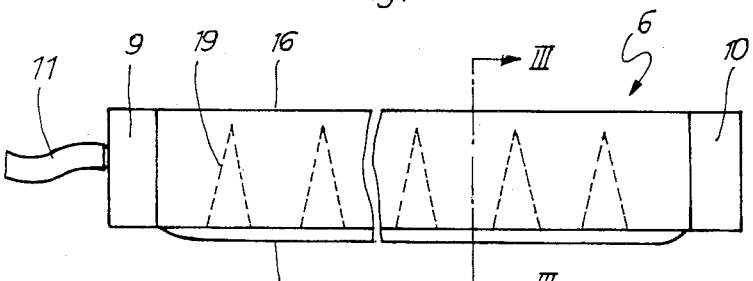
FIG. 2 is a view of the clamping bar of FIG. 1 in plan and looking in the direction of the arrow II in FIG. 1.

It may furthermore be advantageous for the bar clamp to be made such that it may be bent plastically. This is more specially possible when a rigid shell section 16 made of metal is used, whose wall thickness is then made suitably thin and the channel limbs, as marked in broken lines in FIG. 2, are made with acute-angle cutouts 19 so that permanent bending to match a curved workpiece will be possible.

The bar clamp shown may be used not only for holding a workpiece on a table of a machine tool but may furthermore be employed in all cases when something is to be held or fixed, for whatever purpose. One example would be the gripping part of an appliance for handling materials.

A further useful development of the invention is such that the clamping element including the moving wall or the hollow resin section forming it is made of heat resistant material so that when the clamping element is used in connection with a machine tool it is not damaged by the hot turnings.

I claim:

1. A short-stroke clamping device comprising an elongated rigid bar having a rigid back wall and rigid side walls and end walls connected to said back wall and defining a pressure chamber having a long open front side opposite from said rigid back wall, a flexible wall extending across said long open front side and closing said pressure chamber, and a pressure connection connected to one of said end walls for supplying pressure to said pressure chamber to expand said flexible wall in a direction away from said rigid back wall, said flexible wall being at least partly corrugated with corrugations which extend through a thickness of said flexible wall so that said flexible wall is expandable when said pressure chamber is pressurized, said flexible wall includes a flat central area between said side walls of said rigid bar and a corrugated area between said flat central area and each of said side walls so that said flat central area is expandable away from said back wall when said pressure chamber is pressurized.

2. A device according to claim 1, including a one-piece hollow pressure tube disposed in said plastic chamber and forming said flexible wall.

3. A device according to claim 2, wherein said tube has back, side and end portions engaged against said back, side and end walls of said rigid bar and which are all made of hard plastic, said flexible wall of said tube being formed as one part with said back, side and end portions of said tube, and being made of soft plastic.

4. A device according to claim 2, wherein said rigid bar is made of hard plastic.

5. A device according to claim 2, wherein said rigid bar is made of metal.

6. A device according to claim 4, wherein said rigid bar is made of plastically deformable material.

* * * * *